US006137028A

United States Patent [19]

Snow

[11] Patent Number: 6,137,028

[45] Date of Patent: Oct. 24, 2000

[54] METHOD FOR THE DISPOSAL OF OIL FIELD WASTES CONTAMINATED WITH NATURALLY OCCURRING RADIOACTIVE MATERIALS (NORM)

[76] Inventor: Daniel Wayne Snow, P.O. Box 1277, Andrews, Tex. 79714

[21] Appl. No.: 09/219,152

[22] Filed: Dec. 22, 1998

[51] Int. Cl.[7] ..... G21F 9/28

[52] U.S. Cl. ..... 588/250; 405/59; 405/53

[58] Field of Search ..... 588/250, 249; 405/53, 55, 56, 57, 58

[56] References Cited

U.S. PATENT DOCUMENTS

| | | | |
|---|---|---|---|
| 4,576,513 | 3/1986 | Lindorfer et al. . | |
| 4,577,999 | 3/1986 | Lindorfer et al. | 588/250 |
| 4,692,061 | 9/1987 | Lindorfer et al. . | |
| 5,314,265 | 5/1994 | Perkins et al. . | |
| 5,433,553 | 7/1995 | Pearson et al. . | |
| 5,489,740 | 2/1996 | Fletcher . | |
| 5,536,115 | 7/1996 | Keck | 588/250 |
| 5,613,242 | 3/1997 | Oddo | 588/250 |
| 5,734,988 | 3/1998 | Alexander et al. | 588/250 |
| 5,863,283 | 1/1999 | Gardes | 588/250 |

FOREIGN PATENT DOCUMENTS 366182 5/1990 European Pat. Off. .

OTHER PUBLICATIONS

John A. Veil et al, Argonne National Laboratory, Disposal of NORM–Contaminated Oil Field Wastes in Salt Caverns, Aug. 1998.

*Primary Examiner*—Eileen D. Lillis
*Assistant Examiner*—Frederick L. Lagman
*Attorney, Agent, or Firm*—Stephen R. Greiner

[57] ABSTRACT

A method for the disposal of oil field wastes contaminated with naturally occurring radioactive materials (NORM). The method includes the steps of: drilling a pair of wells which intersect in a salt formation, providing a slurry containing NORM wastes and a carrier liquid, injecting the slurry through one of the wells into the salt formation wherein the NORM wastes settle, and removing the carrier liquid from the other one of the wells. One carrier liquid, fresh water, dissolves the salt formation to form and enlarge a cavern for receiving the NORM wastes. The quantities of carrier liquid removed from the salt formation are disposed of by injection into permeable formation remote from the salt formation.

15 Claims, 1 Drawing Sheet

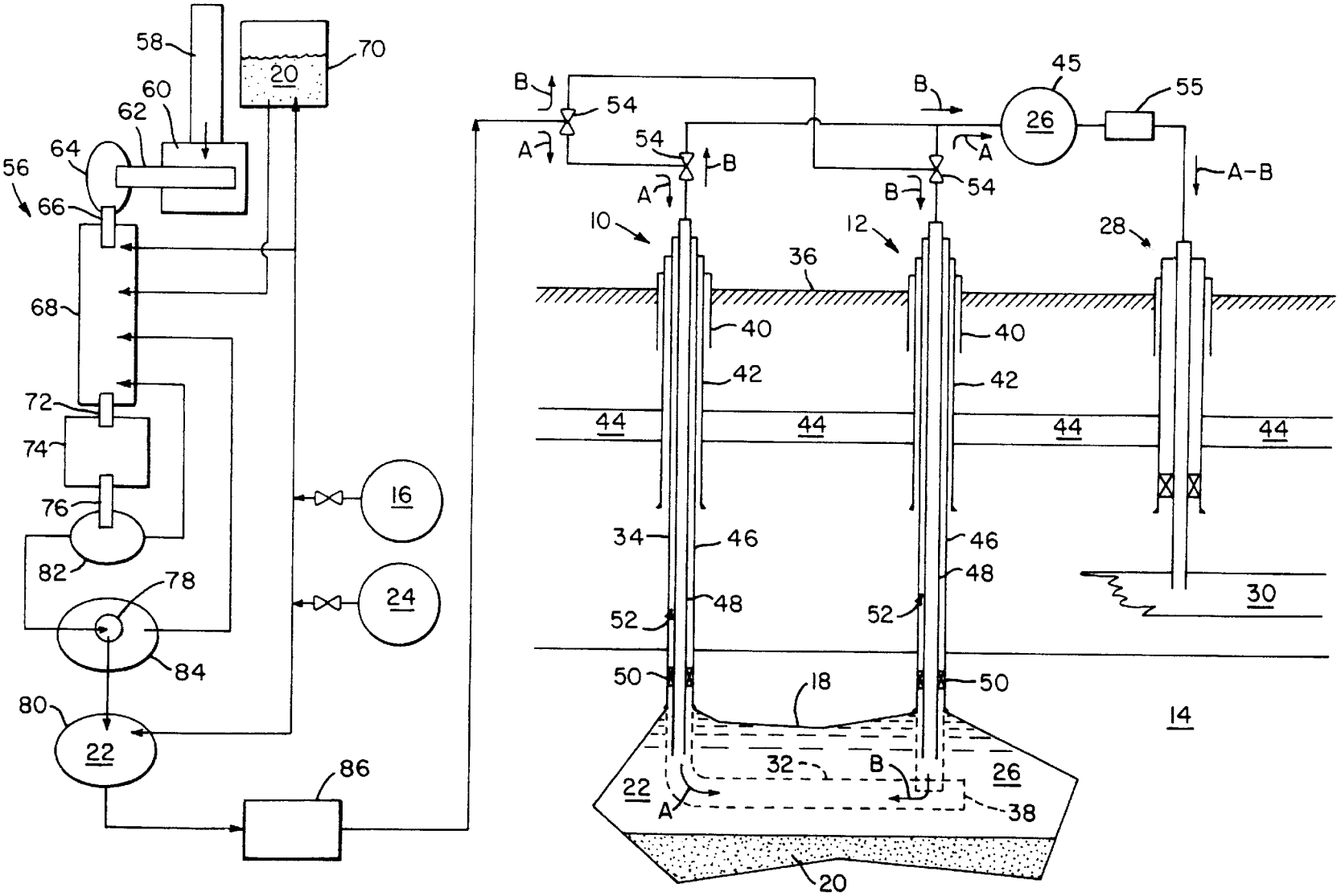
A-B
55
45
26
28
44
30
14
40
42
46
48
50
26
38
54
A
B
12
52
36
18
32
20
10
34
22
16
24
86
70
20
58
60
62
64
66
56
68
72
74
76
82
78
84
80
22

METHOD FOR THE DISPOSAL OF OIL FIELD WASTES CONTAMINATED WITH NATURALLY OCCURRING RADIOACTIVE MATERIALS (NORM)

FIELD OF THE INVENTION

The present invention relates generally to the containment of hazardous waste within a manmade, subterranean cavity.

BACKGROUND OF THE INVENTION

Water, pipe scale, and sludge contaminated with naturally occurring radioactive materials (NORM) are wastes that often accompany the recovery of oil and gas from subterranean reservoirs. Most of the NORM-contaminated water is currently disposed of through injection back into the reservoirs from which it came. Unfortunately, solid NORM wastes, like scale and sludge, require extensive processing before disposal through underground injection into permeable rocks or land spreading can be accomplished. Because of the need to reduce the high costs involved in the conventional disposal of solid NORM wastes, it has been proposed that such be injected into salt caverns.

Salt caverns are typically created by injecting fresh water into subterranean salt formations and withdrawing the resulting brine. This process is referred to as solution mining. Over time, numerous salt caverns have been solution mined by the petroleum industry for use in storing hydrocarbons and for disposing nonhazardous oilfield wastes (NOW). To date, salt caverns have not been used to dispose of NORM wastes due to concerns that they may leak radioactive materials into surrounding rocks and, perhaps, into fresh water aquifers.

It has been noted that the release of NORM wastes from salt caverns could result from one of five scenarios: (1) inadvertent intrusion; (2) failure of the cavern seal; (3) leakage through cracks; (4) leakage through interbeds of permeable material; and, (5) a partial cavern roof fall. Risk estimates indicate that there is a very low probability of any of these scenarios occurring provided that the salt cavern is properly designed and operated.

A properly designed salt cavern can be a leak-free repository for NORM waste. Nevertheless, the present inability to control the flow of water within a subterranean salt formation during solution mining has made it difficult for the petroleum industry to convert salt cavern design concepts into reality in the field. A need, therefore, exists for a new method for forming salt caverns in a controlled manner and then depositing NORM wastes therein.

SUMMARY OF THE INVENTION

In light of the problems associated with the known methods of disposing of oil field wastes contaminated with NORM, it is a principal object of the invention to provide a method for the disposal of NORM wastes in a salt cavern which is safe, cost effective, and can be performed with conventional, oil field equipment.

It is another object of the invention to provide a method of the type described wherein a cavern of substantial strength and known dimensions can be formed in a salt formation being as little as a few feet thick.

It is a further object of the invention to provide a method of the type described wherein the deposition of NORM wastes within a salt cavern accompanies the formation of the cavern itself thereby reducing the time required to dispose of NORM wastes.

Briefly, the disposal method in accordance with this invention achieves the intended objects by including the steps of: drilling a pair of wells which intersect within a salt formation, providing a slurry containing NORM wastes and a carrier liquid, injecting the slurry through one of the wells into the salt formation wherein the NORM wastes settle, and removing the carrier liquid from the other one of the wells. One carrier liquid, fresh water, dissolves the salt formation to help form and enlarge a cavern for receiving the NORM wastes. The quantities of carrier liquid removed from the salt formation are disposed of by injection into a permeable formation remote from the salt formation.

Prior to injecting the slurry, it is preferable to inject fresh water alone into one of the wells and simultaneously withdraw the resulting brine from the other one of the wells so as to dissolve a cavern in the salt formation. Such a cavern permits larger settling times for slurry positioned therein. Nonetheless, by employing fresh water as a carrier liquid, this step may be omitted in cases where the portions of the two wells open to the salt are relatively long, for example. Thus, the injection of slurry may be begun immediately after drilling the wells.

The creation of a subterranean salt cavern with a well having a horizontal section as described below allows the geometry of the cavern to be controlled so that the strength of the cavern roof and the life of the cavern can be maximized. Horizontal well operations can be employed in any salt strata of sufficient thickness to permit horizontal drilling.

The foregoing and other steps, objects and advantages of the present invention will become readily apparent upon further review of the following detailed description of the preferred method as illustrated in the accompanying drawing.

BRIEF DESCRIPTION OF THE DRAWING

The present invention may be more readily described with reference to the accompanying drawing FIGURE which diagrammatically illustrates the preferred method of the present invention.

DETAILED DESCRIPTION

A method for the disposal of oil field wastes contaminated with naturally occurring radioactive materials in accordance with the present invention is illustrated in the accompanying drawing FIGURE. The method includes the drilling of an injection well 10 and a recovery well 12 so that they intersect within a subterranean salt formation 14. Next, fresh water from storage tank 16 is flowed between the wells 10 and 12 to dissolve a cavern 18 in the salt formation 14. A slurry 22 of NORM wastes 20 and a liquid carrier (fresh water from tank 16 or salt water from storage tank 24) is then pumped down injection well 10 and into the cavern 18.

As the slurry 22 is injected, the cavern 18 acts as an liquids/solids separator. The relatively dense NORM wastes 20 sink and accumulate on the bottom of the cavern 18. Salt water 26 displaced by the incoming slurry 22 is removed from the cavern 18 through the recovery well 12 and is subsequently discarded in a disposal well 28 open to a permeable subterranean formation 30 isolated from the salt 14.

As the cavern 18 fills with NORM wastes 20, the recovered water 26 tends to become "dirtier" with a higher concentration of wastes. The cavern 18 may be considered to be "full" of NORM wastes 20 when the return of wastes with the displaced salt water 26 becomes problematic. The cavern 18 is sealed when full.

It is essential that the injection well 10 and recovery well 12 be drilled in a manner that permits fluid communication between them. This is accomplished by drilling the injection well 10 so that it has a horizontal section 32 in the salt 14 and a vertical section 34 connecting the horizontal section 32 to the ground surface 36. Next, from a place on the surface 36 above the bottom hole location 38 of the injection well 10, the recovery well 12 is drilled vertically to intersect the horizontal section 32.

During drilling, the injection well 10 and the recovery well 12 are reinforced to prevent collapse. For both wells 10 and 12, a relatively-short conductor pipe 40 is provided adjacent the ground surface 36. An intermediate string of casing 42, long enough to isolate the wells 10 and 12 from fresh water aquifer 44, is positioned within each conductor pipe 40 and is cemented in place. Finally, a work string of casing 46, having a length sufficient to penetrate the salt 14, is positioned within each intermediate string 42 and is cemented in place to further protect aquifer 44.

The injection well 10 and the recovery well 12 are both provided with a tubing string 48 extending from the ground surface 36 to the salt 14. A packer 50 on each tubing string 48 isolates the annulus 52 of each well 10 and 12 from the salt 14. To provide back-pressure on each packer 50, the annulus of each well 10 and 12 is filled with a liquid such as fresh water (not shown).

After the injection well 10 and the recovery well 12 are completed, a predetermined volume of fresh water from tank 16 is pumped down the tubing string 48 of the injection well 10, through the salt 14, and up the tubing string 48 of the recovery well 12. If the flow rate is too high, the water obtained at the ground surface 36 from the recovery well 12 will be unsaturated with salt and may be returned to injection well 10 for reuse. Once the fresh water becomes saturated with salt, it is discarded by injection into disposal well 28.

After pumping the first volume of fresh water through the salt 14, the roles of the injection well 10 and recovery well 12 are reversed by appropriate switching of valves 54. Now, a second volume of fresh water equal to the first is pumped down the tubing string 48 of recovery well 12, through the salt 14, and up the tubing string 48 of injection well 10. The pumping of water into the recovery well 12 continues until salt-saturated water is recovered from the injection well 10. When such a recovery is made, the nominal diameter of the horizontal section 32 of the injection well 10 optimally will have increased from several inches to many feet thereby forming a salt cavern 18 of large capacity.

NORM slurry 22, comprising fresh water from tank 16 and NORM wastes 20, is pumped along the flow path indicated by arrows "A" in the drawing. First, the slurry 22 travels down the tubing string 48 of injection well 10 into the cavern 18. Due to density differences, the NORM wastes 20 settle out of suspension in the cavern 18 between the injection well 10 and the recovery well 12. By controlling slurry flow rates and slurry rheology, an operator can vary the distance from the injection well 10 that NORM wastes 20 will settle thus ensuring that the cavern 18 will be filled with NORM wastes to the maximum possible extent.

The fresh water used to form the NORM slurry 22 continues to dissolve salt 14 and transport such from the recovery well 12. The recovered salt water 26 is retained in storage tank 45. When there is a sufficient volume of water 26 in tank 45, a pump 55 whose outlet is in fluid communication with the disposal well 28 is energized to deliver the water 26 to permeable formation 30. Thus, the cavern 18 is automatically enlarged as the deposition of NORM wastes 20 therein continues.

The periodic reversal of the roles of the injection well 10 and the recovery well 12 ensures both the even dissolution of the salt 14 and the even deposition of NORM wastes 20 in the cavern 18. Upon reversal to the fluid flow path indicated by arrows "B" in the drawing, NORM slurry 22 is pumped down the tubing string 48 of recovery well 12 into the cavern 18 where the NORM wastes 20 will settle to the bottom of the cavern. Fresh water used to form the NORM slurry dissolves the salt 14, is removed from the cavern 18 through tubing string 48 of injection well 10, and is discarded through the disposal well 28.

Once it is determined through volumetric calculations or otherwise that the cavern 18 has reached its maximum safe dimensions. The NORM wastes 20 are slurried with salt-saturated water from tank 24 rather than fresh water from tank 16. Thus, dissolution of the salt 14 is terminated, and the cavern 18 can continue to be filled with NORM wastes 20 as described above until NORM waste returns become problematic. When the return of NORM wastes from the cavern 18 becomes excessive, the injection well 10 and the recovery well 12 are plugged and abandoned.

NORM wastes 20 are initially delivered to the slurry production apparatus 56 by means of trucks (not shown) driven onto off-load ramp 58. NORM wastes in excess of 1" nominal diameter are deposited from the trucks into an aggregate pit 60 where they are transported by a conveyor belt 62 to a cone crusher 64. The crusher 64 reduces the nominal diameter of the wastes 20 delivered to it to less than 1" and subsequently delivers them by means of a bucket-lift conveyor 66 to a feed stock tank 68. NORM wastes 20 having a nominal diameter of less than 1" at the time of off-loading, however, are diverted from the crusher 64 and, instead, deposited in a mixing pit 70 where they are combined with fresh water from the storage tank 16 and fed to the feed stock tank 68.

NORM wastes 20 are transported from the feed stock tank 68 by a drag-bottom conveyor 72 to a ball mill 74 which further reduces the particle size of the NORM wastes delivered to it. NORM wastes 20 leaving the ball mill 74 are passed over a trommel screen 76 and through a hydrocyclone 78 to ensure that NORM wastes of a predetermined size are delivered to the slurry tank 80. NORM wastes 20 having a particle size which is too large as determined by the screen 76 or the hydrocyclone 78 are captured, respectively, in tanks 82 and 84 and are returned to the feed stock tank 68.

In the slurry tank 80 the finely ground NORM wastes 20 are mixed with additional volumes of water from storage tank 16 or 24 to form a slurry 22 having suitable Theological characteristics. A pump 86 delivers the slurry 22 to either the injection well 10 or recovery well 12 as desired by the operator. Thus, according to the described method, the disposal of NORM wastes 20 in cavern 18 may be performed in a safe and cost effective manner.

While the inventive method and the apparatus for performing such has been described with a high degree of particularity, it will be appreciated by those skilled in the art that modifications may be made thereto. For example, the number and location of injection and recovery wells may be varied to maximize the cavern's size or the rate at which NORM wastes can be pumped into the cavern. Therefore, it is to be understood that the present invention is not limited to the method described above, but encompasses any and all methods within the scope of the following claims.

I claim:

1. A method for the disposal of oil field wastes contaminated with naturally occurring radioactive materials, comprising the steps of:

drilling a first well into a salt formation;

drilling a second well so as to intersect said first well within said salt formation;

providing a slurry of wastes, contaminated with naturally occurring radioactive materials, and a relatively less-dense carrier liquid;

injecting said slurry through said first well into said salt formation wherein said wastes, being more dense than said carrier liquid, settle within said first well; and, removing said carrier liquid from said first well by drawing such through said second well.

2. The method according to claim 1 wherein said carrier liquid is fresh water.

3. The method according to claim 1 wherein said carrier liquid is salt water.

4. The method according to claim 3 wherein said carrier liquid is saturated with salt.

5. A method for the disposal of oil field wastes contaminated with naturally occurring radioactive materials, comprising the steps of:

drilling a first well into a salt formation;

drilling a second well so as to intersect said first well within said salt formation;

injecting fresh water into said first well and simultaneously withdrawing the resulting brine from said second well thereby dissolving a cavern in said salt formation;

providing a slurry of wastes, contaminated with naturally occurring radioactive materials, and a relatively less-dense carrier liquid;

injecting said slurry through said first well into said cavern wherein said wastes, being more dense than said carrier liquid, settle within said cavern; and, removing said carrier liquid from said cavern by drawing such through said second well.

6. The method according to claim 5 and further comprising the steps of:

drilling a third well into a permeable formation remote from said salt formation; and, injecting said liquid carrier removed from said cavern through said third well into said permeable formation.

7. The method according to claim 5 and further comprising the steps of:

terminating injecting said slurry through said first well;

terminating removing said carrier liquid from said cavern by drawing such through said second well;

injecting said slurry through said second well into said cavern wherein said wastes, being more dense than said carrier liquid, settle within said cavern; and, removing said carrier liquid from said cavern by drawing such through said first well.

8. The method according to claim 5 wherein said carrier liquid is fresh water.

9. The method according to claim 5 wherein said carrier liquid is salt water.

10. The method according to claim 9 wherein said carrier liquid is saturated with salt.

11. A method for the disposal of oil field wastes contaminated with naturally occurring radioactive materials, comprising the steps of:

drilling a first well into a salt formation;

drilling a second well so as to intersect said first well within said salt formation;

drilling a third well into a permeable formation remote from said salt formation;

injecting fresh water into said first well and simultaneously withdrawing said water through said second well thereby dissolving a cavern in said salt formation;

terminating injecting fresh water into said first well and withdrawing said water from said second well;

injecting fresh water into said second well and simultaneously withdrawing said fresh water through said first well thereby enlarging said cavern;

providing a slurry containing wastes, contaminated with naturally occurring radioactive materials, and a less-dense carrier liquid;

injecting said slurry through said first well into said cavern wherein said wastes, being more dense than said carrier liquid, settle within said cavern;

removing said carrier liquid from said cavern by drawing such through said second well; and, injecting said carrier liquid removed from said cavern through said third well into said permeable formation.

12. The method according to claim 11 and further comprising the steps of:

terminating injecting said slurry through said first well;

terminating removing said carrier liquid from said cavern by drawing such through said second well;

injecting said slurry through said second well into said cavern wherein said wastes, being more dense than said carrier liquid, settle within said cavern; and, removing said carrier liquid from said cavern by drawing such through said first well.

13. The method according to claim 11 wherein said carrier liquid is fresh water.

14. The method according to claim 11 wherein said carrier liquid is salt water.

15. The method according to claim 11 wherein said carrier liquid is saturated with salt.

* * * * *